US005207367A

United States Patent [19]

Dunn et al.

[11] Patent Number: 5,207,367

[45] Date of Patent: May 4, 1993

[54] DISPENSING CONTAINER

[75] Inventors: Martin T. Dunn, Hartsville; Dennis R. Taylor, Florence; Troy W. Johnson, Jr., Hartsville, all of S.C.

[73] Assignee: Sonoco Products Company, Hartsville, S.C.

[21] Appl. No.: 665,675

[22] Filed: Mar. 7, 1991

[51] Int. Cl.[5] ..... B65D 13/00; B26F 3/02

[52] U.S. Cl. ..... 225/49; 225/39; 225/46; 206/409; 206/509

[58] Field of Search ..... 225/39, 48, 49, 52, 225/46; 206/409, 408, 509, 508; 16/DIG. 13, 225, 227

[56] References Cited

U.S. PATENT DOCUMENTS

| | | | |
|---|---|---|---|
| D. 305,986 | 2/1990 | Christiansen et al. | D9/424 |
| 2,613,879 | 10/1952 | Carr, Jr. | 225/52 X |
| 2,633,396 | 3/1953 | Kawecki | 225/39 X |
| 2,687,157 | 8/1954 | Cowan | 16/DIG. 13 X |
| 2,861,753 | 11/1958 | Sipior . | |
| 3,193,427 | 7/1965 | Rogers . | |
| 3,351,270 | 11/1967 | Hohnjec | 16/DIG. 13 X |
| 3,477,624 | 11/1969 | Branyon et al. . | |
| 3,531,032 | 9/1970 | Miles, Jr. | 206/409 X |
| 3,679,146 | 7/1972 | Klitzke | 242/55.53 |
| 3,933,288 | 1/1976 | Struble | 225/49 |
| 4,130,228 | 12/1978 | Perrin | 225/19 |
| 4,191,307 | 3/1980 | LeCaire, Jr. et al. | 221/45 |
| 4,238,065 | 12/1980 | Ragsdale | 225/47 |
| 4,353,912 | 10/1982 | Bonk | 221/46 |
| 4,399,935 | 8/1983 | Nelder | 225/49 |
| 4,582,234 | 4/1986 | Marcoux | 225/48 |
| 4,637,514 | 1/1987 | Kildea et al. | 206/406 |
| 4,726,091 | 2/1988 | Joyce | 16/DIG. 13 X |
| 4,832,198 | 5/1989 | Alikhan | 206/509 X |
| 4,844,263 | 7/1989 | Hadtke | 206/509 X |

*Primary Examiner*—Eugenia Jones

*Attorney, Agent, or Firm*—Bell, Seltzer, Park & Gibson

[57] ABSTRACT

A dispensing container for containing a roll of sheet material and dispensing sheets from the roll is disclosed. The dispensing container includes a container body with integrally formed front, rear, bottom and side walls and an open top. A top cover is flexibly connected to the rear wall of the container body and is movable between an open and a substantially closed position. The cover is biased in a substantially closed position adjacent the top of the container body for maintaining the roll of sheet material in the container body. Serrations are integrally formed in the container body for cutting sheet material dispensed from the container.

25 Claims, 3 Drawing Sheets

DISPENSING CONTAINER

FIELD OF THE INVENTION

This invention relates to a dispensing container for containing a roll of sheet material and dispensing sheets from the roll, and a method of forming the dispensing container.

BACKGROUND OF THE INVENTION

Dispensing containers are used for holding a roll of sheet material, such as a roll of aluminum foil or plastic wrap, and for dispensing sheets from the roll. Many of the numerous, commercially available dispensing containers are formed from a thin paperboard material which is folded to form a container body and a top cover portion. The roll of sheet material is contained within the container body and maintained in the container body by the top cover portion. A user typically withdraws sheets from the container body by manually grasping the leading edge of the sheet material and pulling. The sheet is ripped by tearing the sheet material along a cutting edge, such as a metal strip having cutting serrations, which is attached on an upper portion of the front wall. This type of dispensing container has been in use commercially for many years. Examples of this type include the dispensing containers which are disclosed in U.S. Pat. Nos. 4,238,065; 3,477,624; and 2,861,753.

In the present commercial era, recycling of products is desirable. However, paperboard dispensing containers having metal tear strips can be recycled only with difficulty because the attached metal tear strip must be removed before recycling. The metal tear strip also increases manufacturing complexity because an additional manufacturing step is required for attaching the cutting strip to the container body.

In an attempt to eliminate the requirement of attaching a separate cutting strip to the container body, it has been proposed to form serrations on the paperboard container body and then to coat the serrations with a suitable reinforcing resin such as a resorcinol containing phenolic resin as disclosed in Rogers U.S. Pat. No. 3,193,427. Although the additional manufacturing step of attaching a separate cutting strip is eliminated, the container body typically is not recyclable unless the reinforcing coating is removed from the container body. Additionally, the application of a separate reinforcing coating sometimes requires a cure time during manufacture which prolongs the manufacturing process.

It has also been proposed to replace the use of paperboard with a thermoformed plastic, one-piece container body having an integrally attached container top and an integral cutting edge on the container body. Kildea et al U.S. Pat. No. 4,637,594 discloses a dispensing container where two, triangular configured hollow body shells are joined together. Protuberances positioned on the side of one hollow body shell are received into troughs positioned on the other hollow body shell to maintain both shells in a closed position. A flap cover is folded against one of the walls to aid in guiding the leading edge of the sheet material out from the container. This integral, one-piece dispensing container is reusable and recyclable; however, the container relies on a latching mechanism for closure and the "extra" flap cover which aids in guiding the leading edge of the sheet material out from the container adds substantially to the cost of fabricating the container.

SUMMARY OF THE INVENTION

The present invention provides an integrally formed dispensing container for a roll of sheet material which does not require latching mechanisms or extra flaps to maintain container closure or to accomplish dispensing of materials. The dispensing container in accordance with the present invention can be integrally thermoformed from a plastic material and can be completely recyclable.

The dispensing container of the invention includes a thermoplastic container body having integrally formed front, rear, bottom and side walls and an open top. A thermoplastic top cover is flexibly connected to the rear wall of the container body and is moveable between an opened and a substantially closed position. The cover is resiliently biased in the substantially closed position adjacent the top of the container body for maintaining a roll of sheet material in the container body. Preferably, the container body is formed from a clear plastic, such as polyethylene terephthalate for allowing a user to view the roll. Because the top cover is resiliently biased into a substantially closed position and is movable into an open position, the dispensing container can be reused. Thus when one roll of sheet material has been used up, it can be replaced with a fresh roll without disposal of the container.

In one advantageous embodiment of the invention, the flexible connection of the top cover and the rear wall comprises a folded polymer sheet portion thermally set into the folded configuration. In another advantageous embodiment, the top cover is heat welded onto the top face of a lip integrally formed in the container body on an upper portion of the rear wall and which extends rearward from the rear wall.

Advantageously, a cutting means is integrally formed in the container body adjacent the top of the front wall for cutting sheet material dispensed from the container. Preferably the cutting means is provided in a lip integrally formed in the container body. The lip is connected to an upper portion of the front wall and extends forward from the front wall. A plurality of serrations, in the form of die-cut saw-tooth configured cutting teeth, are integrally formed in the lip. The front wall is advantageously flexible to allow manual inward pushing of the front wall for facilitating manual grasping of sheet material.

In various preferred embodiments of the invention, the container body includes a stepped flange portion extending along the top portion of at least one of the front and rear walls of the container body for providing strength and rigidity to the container body. At least one bossed ridge can be integrally formed in the bottom wall and extends upward from the bottom wall. The bossed ridge not only provides rigidity to the container body but also provides means for allowing stacking of a plurality of the container bodies one on top of the other. The top cover also preferably includes means upwardly extending and integrally formed in the lid which are dimensioned and adapted for fitting into the exterior of the bottom bossed ridges for allowing stable stacking of a plurality of the container bodies, one on top of the other.

In accordance with another preferred embodiment, the dispensing container is first formed as a preformed blank. The blank is formed by conventional vacuum forming techniques and includes a container body having integrally formed front, rear, bottom and side walls and an open top. A top cover is integrally formed with the container body and flexibly connected to the rear wall of the container body and extends rearward from the rear wall. The container is formed from the blank by folding the top cover over onto the open top and thermally setting the folded portion in the folded position, thereby biasing the top cover in a substantially closed position.

BRIEF DESCRIPTION OF THE DRAWINGS

Some of the advantages of the present invention having been stated, others will be more fully understood from the detailed description which follows and by reference to the accompanying drawings in which.

DESCRIPTION OF THE PREFERRED EMBODIMENT

Figure 1:
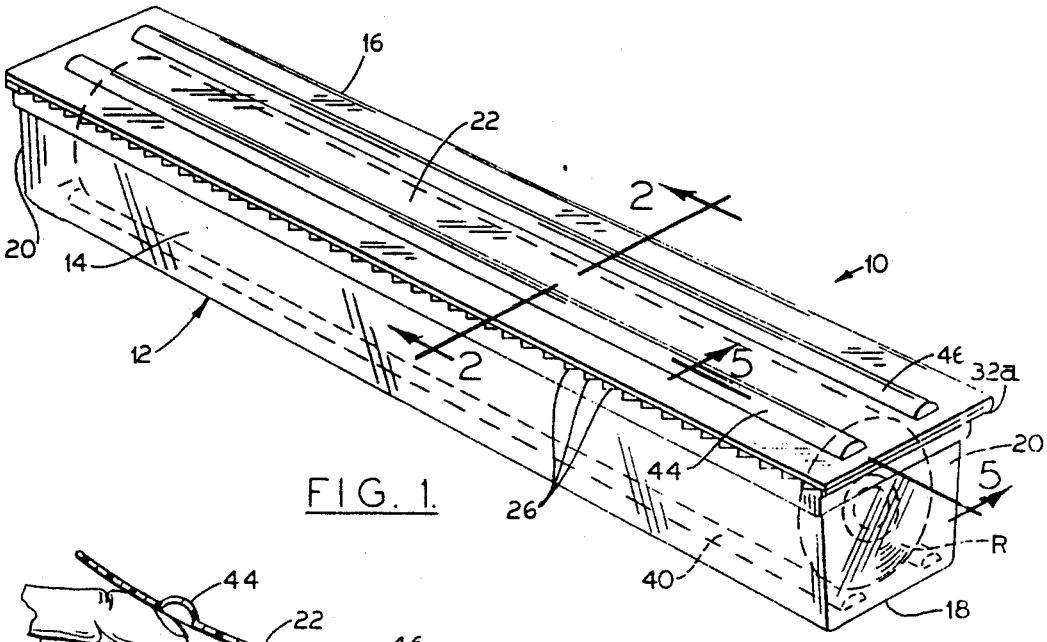
FIG. 1 is an isometric view of the dispensing container in accordance with the present invention.
Figure 3:
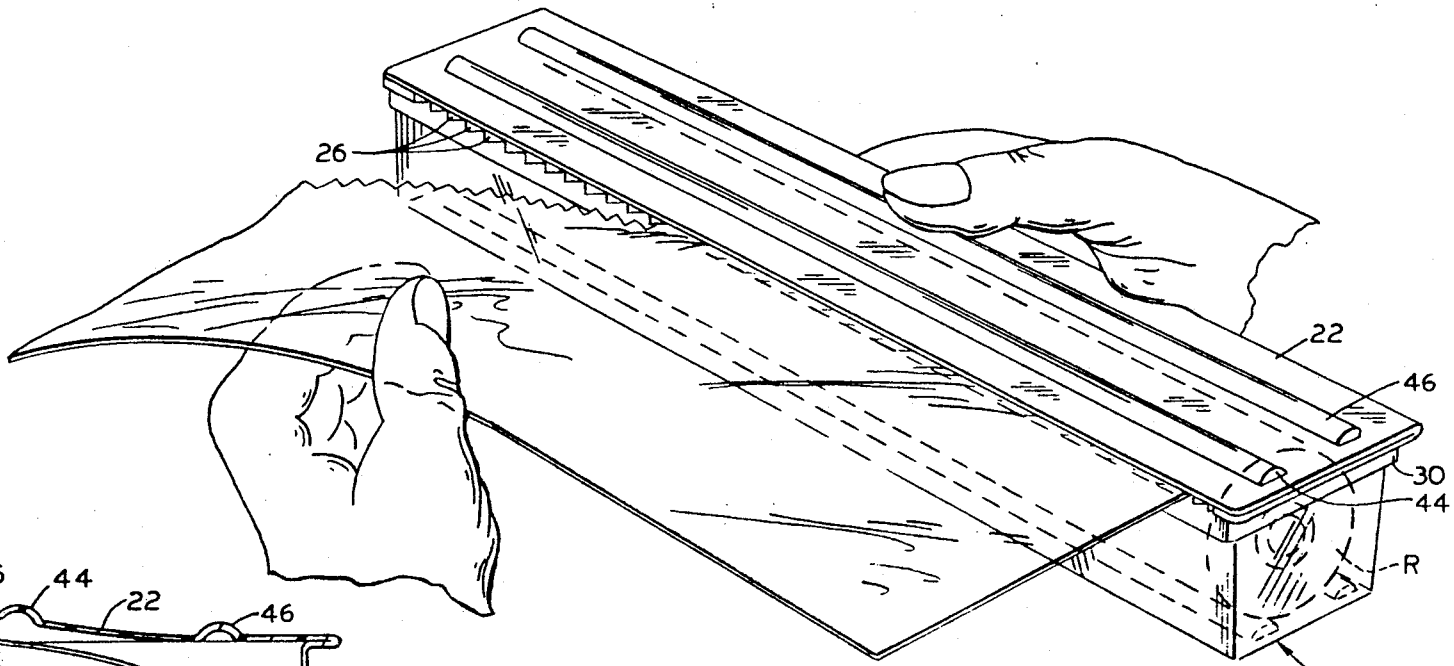
FIG. 3 is an isometric view of the dispensing container and showing a user grasping the leading edge of the sheet material and tearing the sheet along the cutting teeth integrally formed in the front lip of the dispensing container.

Referring now to the drawings and more particularly to FIG. 1, in accordance with the present invention there is illustrated a dispensing container, indicated generally at 10, for containing a roll of sheet material, indicated by the letter R, such as rolls of aluminum foil, plastic wrap or other sheet material which typically are found at most grocery stores and other similar environments. The dispensing container holds the roll of sheet material R and dispenses sheets from the roll (FIG. 3). The dispensing container 10 is thermoformed as a one-piece integral blank which is later formed into an integral, one-piece dispensing container of the present invention.

The dispensing container 10 is formed preferably from a clear plastic such as polyethylene terephthalate, or other similar clear plastic material such as polypropylene, polyethylene, or polycarbonate. Forming the dispensing container of polyethylene terephthalate is desirable because polyethylene terephthalate is tough and forms a strong container. Moreover, many of the commercially available and recyclable containers such as the common two-liter drink bottle are formed of polyethylene terephthalate. Thus, the dispensing container 10 of the present invention can be recycled in many of the normal recycle channels currently in use.

Also, the above-mentioned types of plastics are desirable because they maintain their crystallinity and transparency during thermoforming. The dispensing container 10 is transparent and allows a user to see the roll R contained therein to determine the remaining amount of material available to be dispensed.

Figure 2:
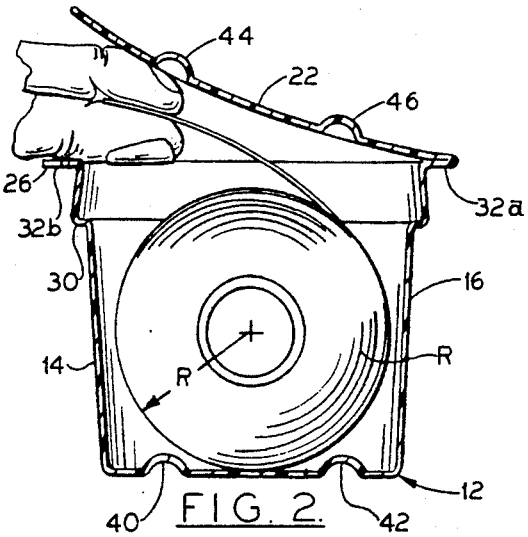
FIG. 2 is a section view taken along line 2—2 of FIG. 1 and showing a user lifting the top cover and grasping the leading edge of the roll of sheet material.
Figure 4:
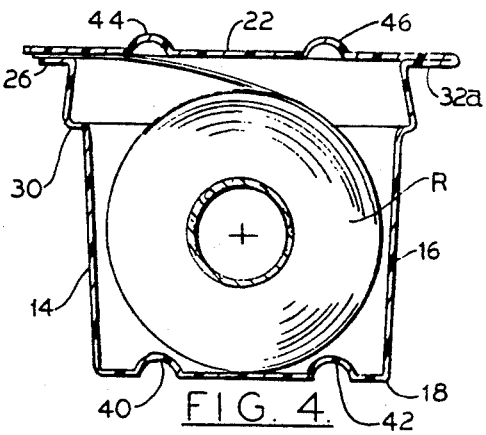
FIG. 4 is a side elevation view of the dispensing container and showing the leading edge of the roll of sheet material which is held by the top cover against the lip and upper edge of the front wall.

As illustrated, generally in FIGS. 1 and 2, the dispensing container includes a container body illustrated generally at 12, elongate and substantially rectangular configured in longitudinal cross section and having integrally formed front 14, rear 16, bottom 18 and side 20 walls and forming an open top. A top cover 22 is flexibly connected to the rear wall 16 of the container body 12 and is movable between an open and a substantially closed position (FIG. 2 . The cover 22 is of a size and shape to close the open top and it is resiliently biased in a substantially closed position adjacent the top of the container body 12 for maintaining the roll of sheet material in the container body (FIG. 4). Cutting means in the form of serrations 26 are integrally formed in the container body 12 adjacent the top of the front wall 14 for cutting sheet material dispensed from the container (FIG. 3). Although the illustrated embodiments show the container body as being elongate for holding the common, commercially available rolls of sheet material such as aluminum foil and plastic wrap material, the container body 12 can be shorter for containing a thin roll of sheet material such as commercially available plastic tape or the like.

The container body 12 includes a stepped flange 30 extending along the top portion of the container body for providing strength and rigidity to the container body (FIGS. 2-5). The stepped flange 30 also provides a larger opening in which a user may grasp with his fingers the leading edge of the sheet material (FIG. 2). The lower portion of the container body 12 below the stepped flange 30 can be made smaller and closer to the size dimension of the roll of sheet material R to aid in preventing excess movement of the roll of sheet material within the container body 12. The side walls 20 also can be tapered slightly to increase the dimension of the top opening relative to the dimensions of the bottom portion of the dispensing container. As illustrated, a lip 32 extends outward from the peripheral upper edge of the dispensing container side walls 20. The lip 32 is substantially perpendicular to the side walls 20 (FIGS. 2-4). The lip 32 is flexible in the vertical direction and the top cover 22 is fixedly connected to the lip portion 32*a* extending from the rear wall 16. The top cover 22 extends forwardly beyond the front portion of the lip 32*b*. This facilitates grasping of the top cover 22 and raising the cover to either grasp the leading edge of the rolls of sheet material R or to replace a used roll of sheet material R with a new roll.

As seen in the drawings, the flexible connection of the top cover 22 to the rear wall 16 advantageously comprises a folded polymer sheet portion thermally set into the folded configuration so that the top cover is resiliently biased into a substantially closed position as illustrated in FIG. 4. The flexible connection can be formed by incorporating a score line 36 (FIG. 8) such as conventionally found with the type of connection referred to in the trade as living hinges, between the top cover 22 and container body 12 during formation of the blank. The flexible connection can be formed also by commercially available techniques for forming other living hinges where the flexible connection includes a line of weakening such as caused by intermittent openings, a reduced thickness of the material, or other living hinge forming techniques.

The top cover preferably is thermally heat set in a substantially closed position. However, the top cover is resiliently biased in the substantially closed position so that it can be raised into an open position (FIG. 2). Once pressure is released from the top cover, the top cover returns to the substantially, closed position.

Because the top cover 22 is resiliently biased into a substantially closed position, and movable to an open position, the dispensing container can be reused. Empty rolls contained in the dispensing container 10 can be removed and replaced with fresh rolls of sheet material R for dispensing sheets from the dispensing container. The rolls of sheet material are easily replaced by opening the top cover 22 and replacing the roll of sheet material R.

Figure 9:
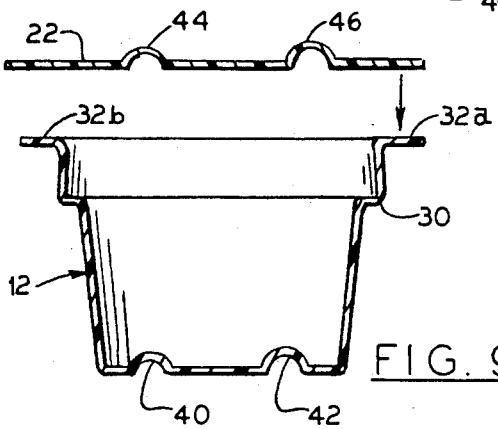
FIG. 9 is a side elevation view of a dispensing container in accordance with a second embodiment of the present invention having the top cover heat sealed onto the container body.
Figure 10:
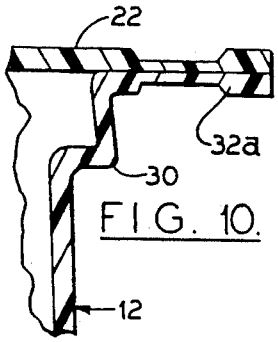
FIG. 10 is an enlarged view of the flexible connection of the top cover and container body in accordance with the second embodiment where the top cover is heat sealed onto a flexible lip integrally formed in the container body.

In the embodiment illustrated in FIGS. 9 and 10, a separate top cover is heat welded onto the face of the lip portion 32*a* extending from the back wall. This is accomplished after the formation of the blank as will be explained later. A score line or living hinge is not needed because the top cover 22 is heat sealed into a substantially closed, resiliently biased position as illustrated in FIGS. 9 and 10.

Figure 8:
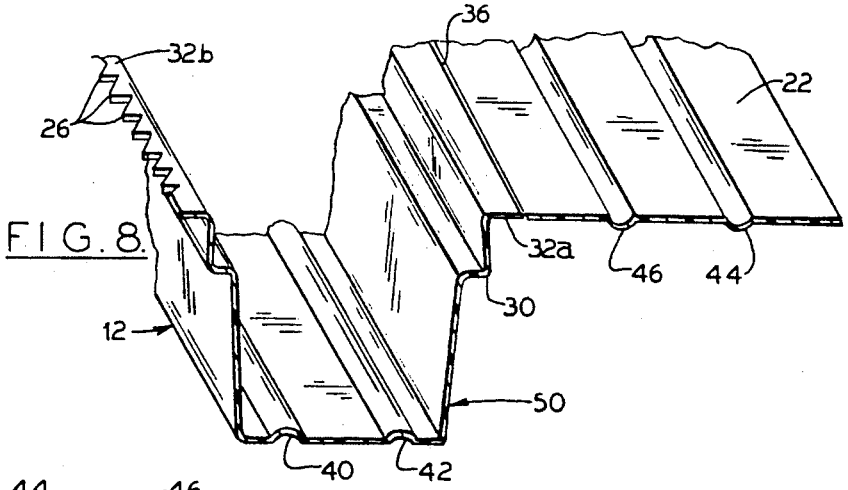
FIG. 8 is a partial isometric view showing a blank used for forming the dispensing container in accordance with the present invention.

The cutting means in the form of serrations 26 are integrally formed in the container body 12 adjacent the top of the front wall 14 for cutting sheet material dispensed from the container (FIG. 8). Preferably the serrations 26 are provided in the form of saw-tooth configured die-cut notches on the front lip 32*b*. These provide sufficient cutting capability for cutting most forms of aluminum foil, plastic wrap and other commercially available rolls of sheet material R typically found at grocery stores and other similar environments. Additionally, the cutting means integrally formed in the container body adjacent the top of the front wall can include integrally formed triangular configured cutting members extending upward on the front lip. Also, if the lip is thick, cutting notches (not shown) can extend partially into the top surface of the lip 32*b* and form a cutting surface on top of the lip.

Figure 5:
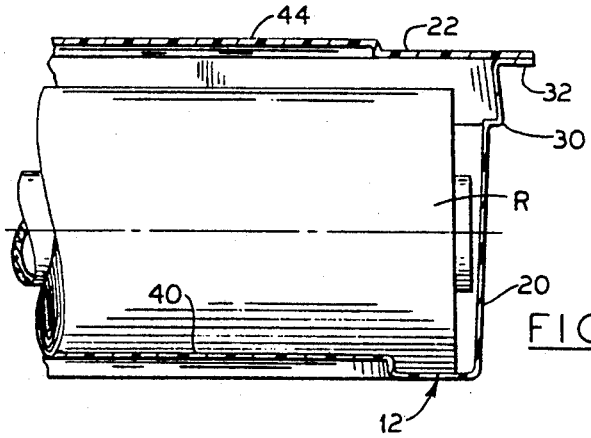
FIG. 5 is a partial sectional view of the dispensing container taken along line 5—5 of FIG. 1.
Figure 11:
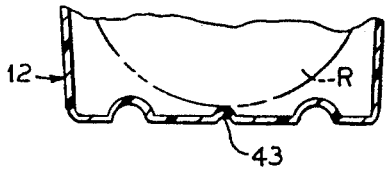
FIG. 11 is a side elevation view of a second embodiment of the dispensing container and showing a bossed ridge positioned medially between longitudinally extending bossed ridges to aid in reducing the contact between the sheet of roll material and bottom wall.

At least one bossed ridge is integrally formed in the bottom wall 18 and extends upward from the bottom wall (FIGS. 2 and 4). The incorporation of at least one bossed ridge into the container body bottom wall 18 provides the additional rigidity to the dispensing container body 12. Also, the top cover 22 can include at least one protrusion for nesting with the bossed ridge and allowing stacking and nesting of the dispensing containers on a store shelf. In the illustrated preferred embodiment, two spaced longitudinally extending bossed ridges 40, 42 are provided in the bottom wall of the container body. The bossed ridges 40, 42 not only add rigidity to the container body 12, but also aid in centering the roll of sheet material R in a medial location within the container body. The bossed ridges 40, 42 can be dimensioned so that the roll of sheet material R contacts both bossed ridges and reduces the amount of friction generated between the roll of sheet material and the interior of the container body during dispensing when the roll of sheet material is rotated within the container body (FIGS. 4 and 5). Additionally, a bossed ridge 43 can be positioned medially between both longitudinally extending bossed ridges 40, 42 to aid in reducing the contact between the sheet of roll material and the bottom wall (FIG. 11).

Figure 7:
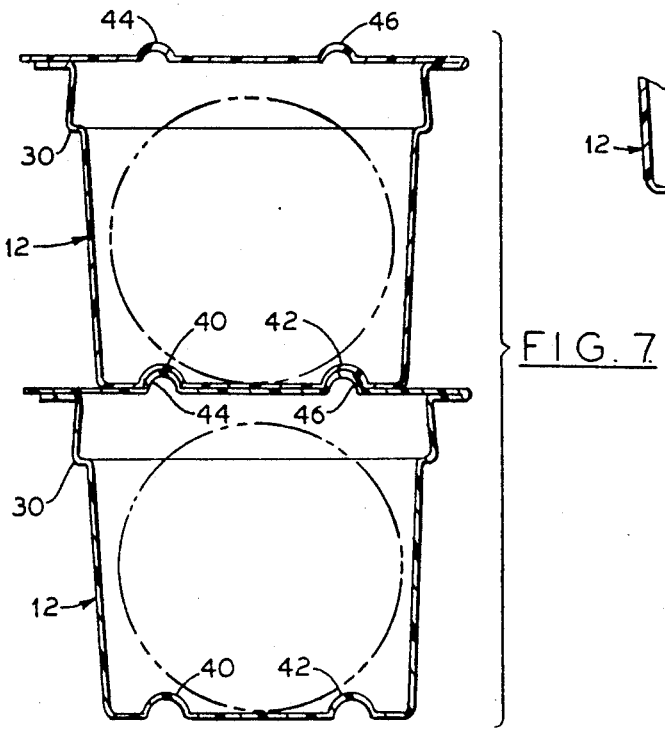
FIG. 7 is a side elevation view of a plurality of dispensing containers and showing stable stacking of the container bodies one on top of the other.

As illustrated in FIG. 7, the two longitudinally extending bossed ridges 40, 42 also allow stable stacking of a plurality of container bodies one on top of the other. As illustrated, the top cover 22 of the dispensing container 10 includes two upwardly extending protrusions 44, 46 which are integrally formed in the top cover. The protrusions 44, 46 are dimensioned to allow close fitting of the protrusions 44, 46 into the exterior of the bottom bossed ridges 40, 42. During stacking of a plurality of dispensing containers, the upwardly extending protrusions 44, 46 nest into the bossed ridges 40, 42 and allow stable stacking. This is advantageous in point-of-purchase displays such as at grocery stores and other commercial establishments where stable stacking is critical for efficient use of space and commercial retailing.

Blank Formation

Advantageously the dispensing container 10 can be formed from a dispensing container blank such as indicated generally at 50 in FIG. 8. The blank 50 is formed by conventional vacuum drawing techniques in which a heated plastic sheet is placed over a vacuum draw cavity. A vacuum is pulled for drawing the sheet into the cavity. Saw-tooth configured teeth 26 can be die cut before or after thermoforming. The resulting formed dispensing container blank 50 includes both the container body 12, having the integrally formed front 14, rear 6, bottom 18 and side 20 walls, and the top cover 22 which is flexibly connected to the lip 32*a* extending from the rear wall 16 of the container body 12. The top cover 22 extends rearward from that wall as shown in FIG. 8. The flexible connection of the top cover 22 and the rear wall 16 can include means defining a line of weakening as described before, such as a score line 36, a reduced wall thickness, or intermittent score line openings.

The blank typically can be formed and then distributed to a manufacturer which engages in the business of manufacturing and marketing dispensing containers of sheet material such as aluminum foil or plastic wrap. Because the lid extends rearwardly, the blanks readily nest into one another.

The manufacturer inserts a roll of sheet material R within the container body of the blank 50. The manufacturer then bends the top cover 22 over into its substantially closed position and thermally sets the top cover 22 into the folded configuration as illustrated in FIG. 4. It is important during this process that the roll of sheet material R is inserted so that the leading edge of sheet material extends upward along the back wall and under the top cover 22 (FIG. 4). This orientation not only facilitates grasping by a user (FIG. 2) but also prevents the development of a high friction area between the sheet material and upper edge of the front wall which would occur if the roll was oriented in the opposite direction.

In the embodiment of the invention shown in FIGS. 9 and 10, the blank 50 is formed without a top cover 22. The top cover 22 is thermoformed in a separate step and provided as a separate piece. The separate top cover is heat sealed onto the rear lip 32*a* extending from the rear wall 16 in a separate step.

Figure 6:
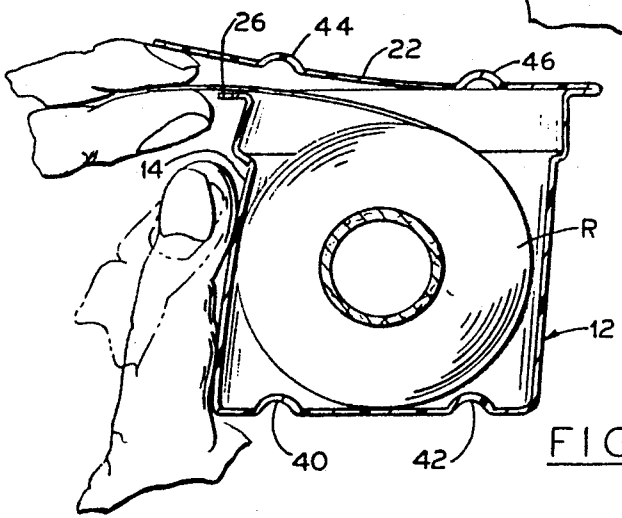
FIG. 6 is a side elevation view of the dispensing container and showing a user flexing the front wall for facilitating grasping of the leading edge of the roll of sheet material.

After the roll of sheet material R is inserted into the blank 50, and the top cover 22 thermal set in the substantially closed position as in the first embodiment, or attached to the rear lip 32*a* as in the second embodiment, the sheet material can be withdrawn easily from the dispensing container by lifting the top cover 22 and grasping the leading edge of the roll of sheet material R (FIG. 2). During dispensing, the front wall 16 of the container body 12 can be flexed inward to facilitate grasping of the leading edge (FIG. 6). After the proper amount of sheet material has been withdrawn from the dispensing container, the container is held in one hand as illustrated in FIG. 3 and the sheet grasped and torn along the serrated cutting edge 26.

In the drawings and specification, there have been disclosed typical preferred embodiments in the invention and, although specific terms are employed, they are used in a generic and descriptive sense only, and not for purposes of limitation. It will thus be recognized that numerous variations can be made within the spirit and scope of the invention as described in the foregoing specification and defined in the following claims.

What is claimed is:

1. A dispensing container for containing a roll of sheet material and dispensing sheets from the roll comprising:

a thermoplastic container body having integrally formed front, rear, bottom and side walls and an open top;

a thermoplastic top cover flexibly connected to the rear wall of the container body and movable between an opened and a substantially closed position, the cover being resiliently biased in the substantially closed position adjacent the top of the container body such that the top cover returns from the opened position to the substantially closed position in the absence of external force for maintaining the roll of sheet material in the container body; and cutting means integrally formed in the container body adjacent the top of the front wall and for cutting sheet material dispensed from the container.

2. A dispensing container according to claim 1 wherein the rear wall includes a flexible lip integrally formed in the container body, the lip being connected to an upper portion of the rear wall and extending rearwardly from the rear wall, the top cover being fixedly connected to the lip.

3. A dispensing container according to claim 2 wherein the top cover is heat welded onto an upper face of the lip.

4. A dispensing container according to claim 1 wherein the front wall includes a lip integrally formed in the container body and joined to an upper portion of the front wall and extending forwardly from the front wall, the lip having said cutting means integrally formed in the lip adjacent a front edge of the lip.

5. A dispensing container according to claim 4 wherein the cutting means includes a plurality of serrations integrally formed in the lip.

6. A dispensing container according to claim 4 wherein the top cover extends forwardly beyond the front lip.

7. A dispensing container according to claim 1 wherein the front wall is flexible to allow manual inward pushing of the front wall for facilitating manual grasping of sheet material.

8. A dispensing container according to claim 1 wherein the container body is elongate and substantially rectangularly configured in longitudinal cross section.

9. A dispensing container according to claim 1 wherein the container body includes a stepped flange extending along the top portion of at least one of said front and rear walls of the container body for providing strength and rigidity to the container body.

10. A dispensing container according to claim 1 wherein the flexible connection of the top cover and the rear wall comprises a folded polymer sheet portion thermally set into a folded configuration.

11. A dispensing container according to claim 1 wherein said thermoplastic container body is formed of a substantially clear thermoplastic material.

12. A dispensing container for containing a roll of sheet material and dispensing sheets from the roll comprising:

an elongated, substantially rectangular, thermoplastic container body having integrally formed front, rear, bottom and side walls and an open top;

a thermoplastic top cover flexibly connected to the rear wall of the container body and movable between an opened and a substantially closed position, the top cover being resiliently biased downward in the substantially closed position adjacent an upper edge of the container front wall such that the top cover returns from the opened position to the substantially closed position adjacent the upper edge of the container in the absence of external force for maintaining the roll of sheet material in the container body; and a plurality of saw-tooth configured serrations integrally formed in the container body on the front wall upper edge and being adapted for cutting sheet material dispensed from the container.

13. A dispensing container according to claim 12 wherein the upper edge of the front wall includes integrally formed in the container body a lip extending forwardly from the front wall, the saw-tooth configured serrations being integrally formed in the lip.

14. A dispensing container according to claim 12 wherein the saw-tooth configured serrations are die-cut notches.

15. A dispensing container for containing a roll of sheet material and dispensing sheets from the roll comprising:

a thermoplastic container body having integrally formed front, rear, bottom and side walls and having an open top;

a thermoplastic top cover flexibly connected to the rear wall of the container body and movable between an open and a substantially closed position, the cover being resiliently biased in the substantially closed position adjacent the top of the container body such that the cover returns from the open position to the substantially closed position in the absence of external force for maintaining the roll of sheet material in the container body;

cutting means integrally formed in the container body adjacent the top of the front wall for cutting sheet material dispensed from the container; and at least one bossed ridge integrally formed in the bottom wall and extending upwardly from the bottom wall and in a direction extending between said side walls.

16. A dispensing container according to claim 15 wherein the top cover includes means upwardly extending and integrally formed and arranged for fitting into the exterior of the bottom bossed ridge for allowing stable stacking of a plurality of the container bodies, one on top of the other.

17. A dispensing container according to claim 15 wherein the bottom wall further includes means positioned on the bottom wall and adapted for minimizing contact of the roll with the bottom wall and for facilitating rotation of the roll during dispensing.

18. A dispensing container according to claim 17 wherein the means facilitating rotation of the roll during dispensing includes at least one bossed ridge integrally formed in the bottom wall and extending upward from the bottom wall and being positioned for engaging a roll held in the container body and minimizing contact of the roll with the container body as the roll is rotated during dispensing.

19. A dispensing container according to claim 15 wherein the container body is elongate and substantially rectangularly configured.

20. A dispensing container for containing a roll of sheet material and dispensing sheets from the roll comprising:

a thermoplastic container body having integrally formed front, rear, bottom and side walls and an open top;

a roll of flexible sheet material contained within the container body and having a leading edge;

a thermoplastic top cover flexibly connected to the rear wall of the container body and movable between substantially open and substantially closed positions, the cover being resiliently biased in the substantially closed position adjacent the top of the container body such that the cover returns from the open position to the substantially closed position in the absence of external force for maintaining the roll of sheet material in the container body, a lip integrally formed in the container body and joined to an upper portion of the front wall and extending forwardly from the front wall and comprising a cutting means integrally formed in the lip; and wherein the leading edge of the top cover extends over at least a portion of said lip extending from the front wall so that the sheet material is dispensed through the space between the lid and the lip.

21. A dispensing container according to claim 20 wherein the cutting means includes a plurality of serrations integrally formed in the lip.

22. A dispensing container according to claim 20 wherein the lip extends around the entire top periphery of the container body.

23. A dispensing container according to claim 20 wherein the lip is flexible and the top cover is rigidly secured to the lip on the rear wall.

24. A dispensing container according to claim 20 wherein the container body includes an outwardly extending stepped flange along the upper portion of the container body for providing strength and rigidity to the container body.

25. A dispensing container according to claim 20 wherein the roll is positioned in the container body so that the leading edge extends upward along the rear wall and under the top cover when dispensing sheets.

* * * * *

UNITED STATES PATENT AND TRADEMARK OFFICE

CERTIFICATE OF CORRECTION

PATENT NO. : 5,207,367

DATED : May 4, 1993

INVENTOR(S) : Dunn et al

It is certified that error appears in the above-indentified patent and that said Letters Patent is hereby corrected as shown below:

TITLE PAGE, ITEM [56]

UNDER REFERENCES CITED:

"4,353,912 10/1982 Bonk" should be -- 4,535,912 8/85 Bonk --

IN THE SPECIFICATION:

Column 6, line 44, "rear 6," should be -- rear 16, --.

Signed and Sealed this

Fourth Day of January, 1994

Bruce Lehman

BRUCE LEHMAN

*Commissioner of Patents and Trademarks*

*Attest:*

*Attesting Officer*